US012509838B2

(12) United States Patent
Laghi

(10) Patent No.: US 12,509,838 B2
(45) Date of Patent: Dec. 30, 2025

(54) MACHINE FOR MAKING FOUNDATIONS EQUIPPED WITH SENSORS TO PROTECT PERSON FROM DANGEROUS AREAS OF THE MACHINE

(71) Applicant: SOILMEC S.P.A., Cesena (IT)

(72) Inventor: Matteo Laghi, Forli (IT)

(73) Assignee: SOILMEC S.P.A., Cesena (IT)

( * ) Notice: Subject to any disclaimer, the term of this patent is extended or adjusted under 35 U.S.C. 154(b) by 86 days.

(21) Appl. No.: 18/248,230

(22) PCT Filed: Oct. 6, 2021

(86) PCT No.: PCT/IB2021/059154

§ 371 (c)(1),
(2) Date: Apr. 6, 2023

(87) PCT Pub. No.: WO2022/074576

PCT Pub. Date: Apr. 14, 2022

(65) Prior Publication Data

US 2023/0383623 A1 Nov. 30, 2023

(30) Foreign Application Priority Data

Oct. 7, 2020 (IT) ..... 102020000023608

(51) Int. Cl.
*E02D 11/00* (2006.01)

(52) U.S. Cl.
CPC ..... *E02D 11/00* (2013.01)

(58) Field of Classification Search
CPC .... E02D 11/00; G06V 20/52; G06V 2201/06; E21B 7/02; E21B 44/00; F16P 3/142
See application file for complete search history.

(56) References Cited

U.S. PATENT DOCUMENTS

2010/0031573 A1 2/2010 Whiting et al.
2015/0269427 A1* 9/2015 Kim ..... G06V 20/52 348/159

(Continued)

FOREIGN PATENT DOCUMENTS

GB 2479749 A 10/2011
GB 2532272 A 5/2016

(Continued)

OTHER PUBLICATIONS

International Search Report and Written Opinion for PCT/IB2021/059154 (Feb. 9, 2022).

*Primary Examiner* — Carib A Oquendo
(74) *Attorney, Agent, or Firm* — Merchant & Gould P.C.

(57) ABSTRACT

A foundation construction machine includes a self-moving/mobile assembly moving the construction machine. An upper structure mechanically connected to the self-moving/mobile assembly has an access point allowing access to the upper structure, and equipped with a walkway surface for standing or walking. A mast/boom mechanically connects to the upper structure, whereon an operating equipment mounts for drilling the ground. A presence sensor integrally mounts to the upper structure to monitor a monitoring region integral with the upper structure and covering the walkway surface. The presence sensor detects presence of a solid body in the monitoring region and sends a detection signal representative of the presence. A control system connected to the presence sensor is configured for receiving the detection signal and for sending a control signal to cause the construction machine to execute a predetermined function(s) when the detection signal indicates presence of a solid body proximate the walkway surface.

27 Claims, 8 Drawing Sheets

(56) References Cited

U.S. PATENT DOCUMENTS

| | | | | |
|---|---|---|---|---|
| 2017/0036602 | A1* | 2/2017 | Kroll | H04N 7/181 |
| 2021/0054701 | A1* | 2/2021 | Holck | E21B 44/10 |
| 2021/0207454 | A1* | 7/2021 | Allara | G01S 13/878 |
| 2022/0138478 | A1* | 5/2022 | Malegam | G06V 20/58 382/103 |

FOREIGN PATENT DOCUMENTS

| | | | |
|---|---|---|---|
| WO | 2014/117874 | A1 | 8/2014 |
| WO | 2019/079899 | A1 | 5/2019 |

* cited by examiner

MACHINE FOR MAKING FOUNDATIONS EQUIPPED WITH SENSORS TO PROTECT PERSON FROM DANGEROUS AREAS OF THE MACHINE

This application is a National Stage Application of PCT/IB2021/059154 filed Oct. 6, 2021, which claims priority to application No. 102020000023608, filed Oct. 7, 2020, in Italy, and which applications are incorporated herein by reference. To the extent appropriate, a claim of priority is made to each of the above disclosed applications.

TECHNICAL FIELD

The present invention relates to a foundation construction machine and a method for controlling such machine.

Such type of machine is configured for working the ground, generally in order to build structural foundation elements, e.g. piles for a new deep foundation or piles for propping up an existing foundation or the support layer of a shallow foundation, or in order to make retaining elements in the ground, e.g. earth retaining walls or waterproofing bulkheads.

Background Art

Machines employed for building foundations are generally called "foundation construction machines". They are typically used in a building yard environment and comprise a base machine, a mast supported by the base machine, and an operating equipment carried by the mast. Such machines are typically controlled by means of commands, i.e. control signals, issued by an operator positioned in a control station mechanically connected to the upper structure and configured for imparting commands for controlling the foundation construction machine, e.g. a cabin or a control board, or by an operator positioned at a distance from the machine, e.g. using a radio control unit or a remote control station. The base machine comprises an upper structure and a self-moving or mobile assembly mechanically connected to each other in a fixed or, via a fifth wheel, rotatable manner; the self-moving or mobile assembly, which is typically an undercarriage, allows the foundation construction machine to move on the ground. The upper structure is generally provided with a structural frame housing several components, e.g. a prime mover, typically a Diesel engine, supplying the necessary power to all the devices of the machine, hydraulic systems, electric systems, and one or more control units, typically PLCs, which, together with suitable input/output modules, sensors, limit switches and electromechanical devices, permit controlling the machine. The upper structure also houses winches adapted to move the operating equipment by means of a rope, typically driven by hydraulic gear motors and braked by overcenter valves and mechanical brakes, and also ballast elements ensuring machine stability during the work. The winches may also have an electrically controlled drive, and therefore may be equipped with an electric motor imparting the rope winding/unwinding motion. The winches may also be driven by a hydraulic unit combined with an electric control signal. The mast (also called "boom" when referring to a crane, i.e. a machine used for foundation construction works only, with no lifting operations) is commonly a structural element having a lattice or boxed construction and a long extension, even in excess of twenty meters, is mechanically connected to the frame on the side opposite to the ballast by means of a kinematic mechanism or a pin hinge to make a swing movement in order to switch from a horizontal position to a substantially vertical position and/or, whenever necessary, in order to change the working radius of the machine, and performs the function of mechanically supporting and also—in some types of foundation construction machines—guiding an operating equipment designed to work the ground according to a given processing technology.

The foundation construction machines known in the art include the so-called "drilling machines", wherein the operating equipment consists of interchangeable equipment and a drill head or a drive head. The interchangeable equipment may be, merely by way of example, a drilling tool (e.g. a bucket, a drill bit, a core sampler) mechanically connected to telescopic rods called "kelly bars", a single "continuous flight auger" or "soil displacement" drilling tool, or else it may be ground consolidation equipment (e.g. of the "jet grouting", "soil mixing", "deep mixing", "Turbojet", "vibro compaction", "stone column", "bottom feed system" types). The operating equipment may also be a vibro-drive equipment, e.g. a hammer or a vibrator, constituting a drive head configured to impart ground driving motion to a sheet pile. The drill head, also referred to as "rotary", is mechanically connected to the mast and can be guidedly made to translate along the mast by means of a rope driven by a winch installed on the upper structure or, as an alternative, by means of a hydraulic cylinder or a rack-type drive system. The drill head is mechanically connected to the interchangeable equipment in order to transfer thereto a rotary motion and a torque of such intensity as to overcome the resistance of the ground and make a hole. The interchangeable equipment may be mechanically associated with the mast in a direct manner by means of a rope of a winch installed on the upper structure, which supports the interchangeable equipment on the pulleys installed at the top of the mast and moves the interchangeable equipment relative to the mast along the longitudinal direction of the hole. Alternatively, the interchangeable equipment may be mechanically associated to the mast in an indirect manner, being moved by the drill head. The drive head may be associated with the mast either directly or indirectly. An additional winch installed on the upper structure, called "service winch", moves an auxiliary rope which, supported by additional pulleys installed at the top of the mast, can be used in order to move foundation elements, such as reinforcement cages, near the hole being made.

The foundation construction machines known in the art also include the so-called "diaphragm wall excavation machines", wherein the operating equipment may be, by way of example, a cutter module, i.e. a frame to which rotary drums equipped with teeth and driven by gear motors are connected in order to make the excavation, or a grab module, i.e. a frame to which mobile clamshells are connected, which are moved by a hydraulic cylinder in order to make the excavation, or else it may be a dynamic compaction mass or a drive head.

In any case, in all known types of foundation construction machines the operating equipment is mechanically associated in a direct manner to the mast, to be moved relative to the mast along the longitudinal direction of the excavation to be made in the ground. From the examples described herein, a person skilled in the art will understand that the definition of foundation construction machine may comprise not only those machine types mentioned above merely by way of non-limiting example, but also other machine types (e.g. also those typically included in the EN16228 product standard series).

The components installed on the upper structure must be subjected to maintenance operations during the service life of the foundation construction machine; by way of example, the mobile parts (rope tensioner, drum, rollers) and the power and control assemblies (gear motor, control valves, sensors) of the winches must be periodically inspected, and the rope needs to be periodically replaced. To this end, the upper structure is provided with raised walkway surfaces in proximity to the components to be serviced, which surfaces can be trodden on by a person. Access thereto is possible through predefined access points in specific locations along the perimeter of the upper structure. The service technician will typically reach such access points by climbing a ladder or steps or, for small-size machines having limited ground clearance, by simply hoisting himself on such access points directly from the ground using available access means (e.g. access ladders).

The winches installed on the upper structure and the walkway surfaces are generally visible from the control station; in some cases, a mirror is available inside the cabin to ensure better vision; in other cases, on bigger machines, the winches can be framed by dedicated closed-circuit cameras, the images of which are continuously shown on a display available to the operator sitting in the cabin. It is thus possible for the operator to monitor the correct winding and unwinding of the rope on the drums of the winches and to visually verify the absence of any people near the walkway surfaces.

A service technician is only allowed to access the walkway surfaces in order to carry out inspection and maintenance work, and the mobile parts of the machine may only be approached when the engine is off. During such operations, the operator checks the position of the technician by means of direct and indirect viewing systems, such as said closed-circuit cameras, and must also keep in audible contact with the technician, e.g. by using transceivers. Should it be necessary to start the machine to make a manoeuver, the operator will first have to make sure that the technician is no longer within the dangerous zone.

In the foundation construction machines known in the art, if a service technician does not comply with the mandatory operating procedures or gains access to the machine when the latter is on, a dangerous situation may arise wherein the technician himself is close to the winches and the latter may suddenly start operating. Complete visibility of the dangerous area will give the operator full control, and the operator will always have to check, before starting the machine, particularly the winches, that nobody is present (and to issue a warning signal, e.g. by sounding the horn, indicating that he intends to start manoeuvring the machine). Nevertheless, a working man not observing the safety rules and climbing up to the winch area without informing the operator while the machine is in operation might be exposed to a risk that only the operator's attention could avoid.

SUMMARY OF THE INVENTION

It is one object of the present invention to provide a foundation construction machine which can reduce the onset of dangerous situations in case a person gains access to the machine, in particular whenever mandatory safety procedures are not complied with and a person approaches dangerous areas while the machine is fully operational.

It is a further object to provide a method for controlling a foundation construction machine.

According to the present invention, these and other objects of the present invention are achieved by a foundation construction machine, and a method for controlling the machine.

It is understood that the appended claims are an integral part of the technical teachings provided in the following detailed description of the present invention. In particular, the appended dependent claims define some preferred embodiments of the present invention that include some optional technical features.

The following will summarize some of the preferred and advantageous aspects of the present invention.

The use of at least one sensor configured for monitoring a monitoring region in proximity to the sensor itself, so oriented as to monitor a region along a walkway surface and/or a predefined access point, and configured for detecting the presence of a solid body in the monitored region, makes it possible, combined with the monitoring and control activity carried out by the operator through the use of direct and/or indirect vision instruments, to detect when a person enters the dangerous area. The control system connected to such sensor, configured to cause the execution of predetermined functions, advantageously ensures the certain execution of predetermined safety functions conceived as appropriate responses to said dangerous situation, and the automatic execution of such functions advantageously makes them independent of the operator's reaction times. In particular, the predetermined functions have priority over any commands imparted by the operator, ignoring any inadequate manual commands that may not remedy the potential dangerous situation. When a person is detected in dangerous areas, the control system will permit, whether automatically or manually, disabling one or more of such predetermined functions if the automatic stopping of a movement of the machine may create dangerous situations, e.g. should this imply the stopping of highly dynamic manoeuvers. Following the intervention of the sensor, manually starting the machine or a movement of its parts will only be allowed if there is certainty that there are no people in dangerous areas, on condition that preventing the machine from starting or its parts from moving will not generate further unsafe situations. Advantageously, the control system is configured for detecting any faults, thus being even safer and more robust. Preferably, the sensor is a laser scanner, since such sensors are particularly reliable even in the presence of dust, dirt, rain, snow, hail, light, steam and, more generally, in the typical severe conditions of a building yard. Optionally, it is also possible to employ a fixed or removable protection, i.e. a cover, under which the sensor can be arranged in extremely severe environmental conditions. Advantageously, the monitoring region of the sensor can be adjusted and adapted according to installation and functional requirements, so as to ensure the best operability. Optionally, the sensor has a variable spatial resolution, so that it is advantageously possible to set a resolution that will exclude from the detection, and hence from the execution of the predetermined functions, any solid bodies other than a person, such as, for example, snow, hail, soil or birds.

Advantageously, the control signal sent by the control system is transmitted via a dual-channel connection, thus ensuring fault tolerance and cross-monitoring between two channels to reach higher levels of functional safety of the control system compared with a single-channel connection, e.g. up to ISO13849-1 category 3 or 4. In addition, the communication bus may use a communication protocol configured with diagnostic mechanisms, resulting in the advantage that any errors in the transmission of the signal between the sensors and the control system will be detected. Furthermore, the control system may temporarily suspend the detection of the presence of a solid body by the sensor, thus advantageously permitting the temporary override of some sensors when installation/removal operations need to be carried out (e.g. when the rope needs to be replaced). The control system may also carry out an initial memorization of the solid bodies detected by the at least one sensor, being thus advantageously able to store a background scenario that will be considered to be safe, wherein stationary (static) solid bodies may be present within the monitored region in normal conditions, without however representing a dangerous situation (characterized by a body in motion).

Further features and advantages of the present invention will become apparent in light of the following detailed description, provided herein merely as a non-limiting example and referring, in particular, to the annexed drawings as summarized below.

DETAILED DESCRIPTION OF THE INVENTION

Figure 1:
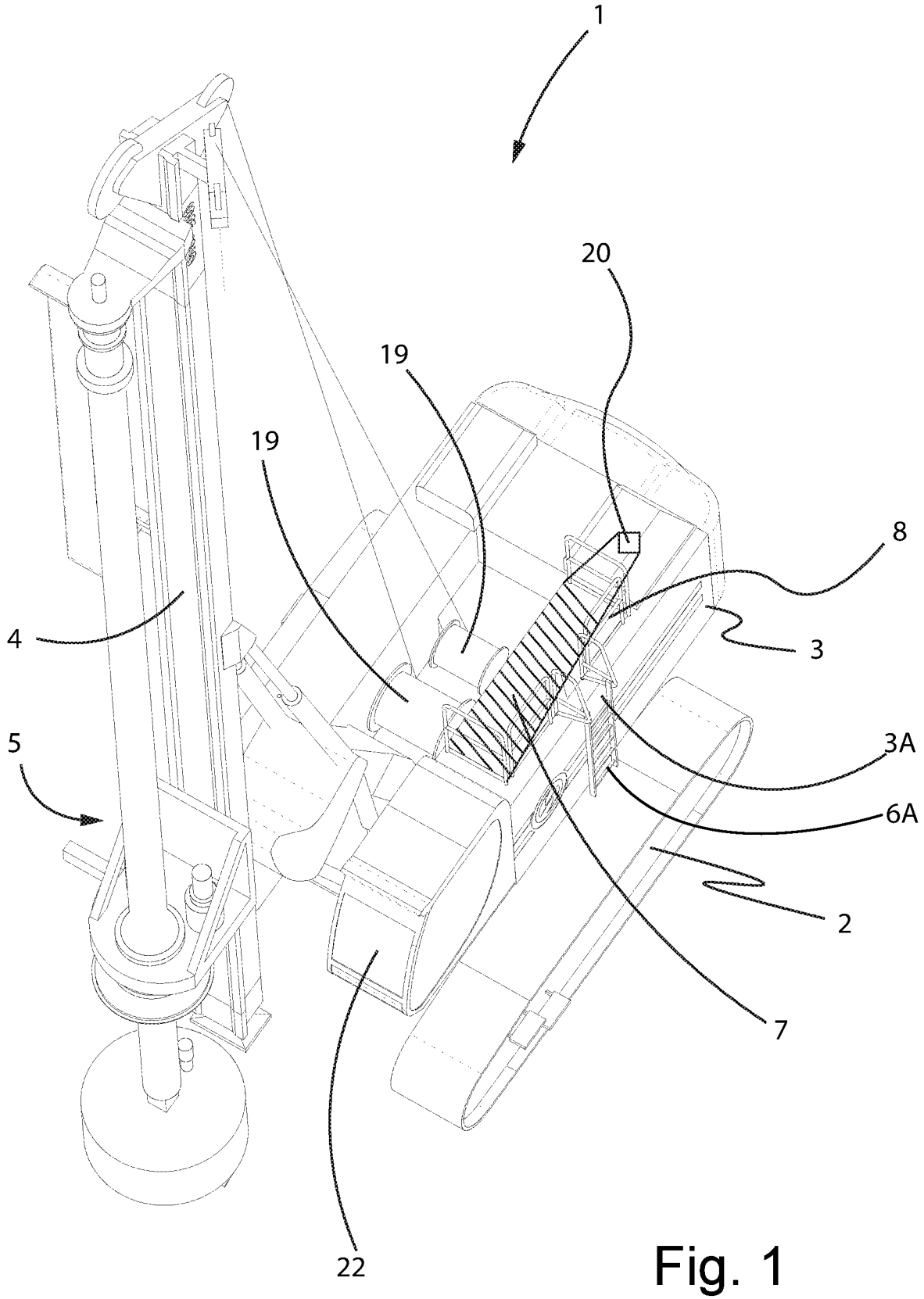
FIG. 1 is a perspective top view of a foundation construction machine made in accordance with a first embodiment of the present invention.

With reference to FIG. 1, there is shown a foundation construction machine, designated as a whole as 1, made in accordance with a first embodiment of the present invention.

Foundation construction machine 1 comprises a self-moving or mobile assembly 2 configured to move on the ground, thus moving said foundation construction machine 1.

Also, foundation construction machine 1 comprises an upper structure 3 mechanically connected, in a rotatable manner, to self-moving or mobile assembly 2, and in particular supported by the latter and equipped with at least one predefined access point 3A configured to allow a person to gain access to upper structure 3.

Furthermore, foundation construction machine 1 comprises a mast 4 mechanically connected to upper structure 3, whereon an operating equipment 5 is configured to be mounted in order to drill the ground.

With particular reference to the embodiment shown in FIG. 1, upper structure 3 has a walkway surface 7 whereon a person accessing upper structure 3 will be able to stand or walk. In particular, walkway surface 7 is adjacent to predefined access point 3A, so that a person wanting to reach walkway surface 7 will be compelled to cross predefined access point 3A. In further construction variants, there may be a plurality of such walkway surfaces 7.

Advantageously, walkway surface 7 is delimited by one or more railings 8 that prevent falling from considerable heights on big machines, as prescribed by safety regulations. Such walkway surface 7 is arranged on upper structure 3 in such a way as to allow a person to gain access to specific components installed on upper structure 3, e.g. for maintenance and inspection purposes. In the embodiment illustrated in FIG. 1, from walkway surface 7 one can gain access to winches 19, e.g. a technician having to service them.

Foundation construction machine 1 comprises also a presence sensor 20 integrally mounted to upper structure 3, so oriented and configured as to monitor a monitoring region integral with upper structure 3 and situated at least above (thus "covering") walkway surface 7 adjacent to predefined access point 3A that allows access to upper structure 3, so as to detect the presence of a solid body in such monitoring region. In particular, said monitoring region may coincide with an internal zone located above walkway surface 7 and within the zone delimited by railings 8 (e.g. a substantially empty (i.e. containing only "air" three-dimensional volume or two-dimensional area). It should therefore be understood that the monitoring region monitored by presence sensor 20 is situated at least above (thus "covering") walkway surface 7, without the latter being necessarily included within the monitoring region. However, the monitoring region may optionally include walkway surface 7.

Presence sensor 20 is further configured for sending a detection signal representative of the presence of said solid body. Thus, presence sensor 20 can detect the presence of a solid body in said monitoring region and send a detection signal representative of the presence of the solid body.

Figure 2:
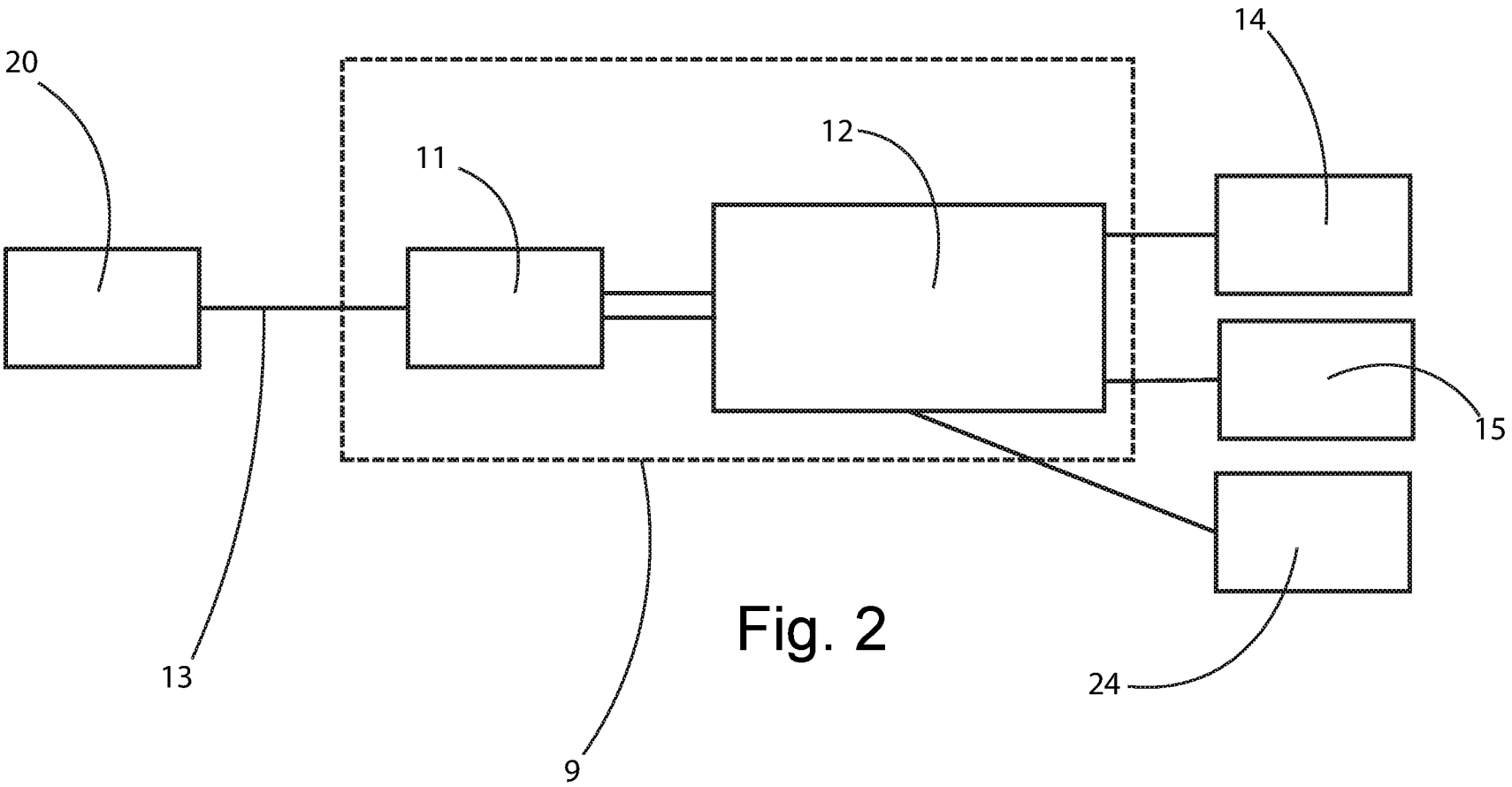
FIG. 2 is a block diagram showing a sensor and a control system of the foundation construction machine represented in FIG. 1, according to a preferred configuration of the present invention.

With reference to FIG. 2, foundation construction machine 1 comprises a control system 9 operationally connected to presence sensor 20. Control system 9 is configured for receiving the detection signal and for sending one or more control signals intended to cause said foundation construction machine 1 to execute one or more predetermined functions when the detection signal is representative of the presence of a solid body in proximity to walkway surface 7.

Due to such technical features, the occurrence of dangerous situations is considerably reduced in case a person undesirably gains access to foundation construction machine 1 through predefined access point 3A, due to the activation of automatic procedures following the transmission of the control signal.

Merely by way of non-limiting example, the following will describe in greater detail some structural features of foundation construction machine 1 shown in FIG. 1.

In the embodiment illustrated in FIG. 1, foundation construction machine 1 is, in particular, a so-called "drilling machine" configured for drilling the ground for building foundation piles.

In particular, foundation construction machine 1 comprises at least one winch 19 mounted on upper structure 3, in particular arranged in a housing formed in said upper structure 3. Winch 19 is configured for driving and/or moving operating equipment 5 (or at least some parts thereof) or, working as a "service winch", for moving objects useful for the drilling activity (e.g. reinforcement steel for piles being cast). In some variants, e.g. a foundation construction machine obtained from a crane, there may be three winches, and the third winch is used for moving the rear stand, necessary for lifting the lattice arm, in order to switch from an idle position to a working position, e.g. for diaphragm wall excavation. As will be described more in detail below, in the embodiment illustrated in FIG. 1 predefined access point 3A and walkway surface 7 adjacent thereto face a portion of upper structure 3 from which winch 19 is accessible.

In FIG. 1 upper structure 3 has a substantially rectangular shape when viewed from above, and therefore has a pair of longer sides, called side panels, and a pair of shorter sides forming the front side (i.e. the side to which mast 4 is typically mechanically connected) and the tail rear side (i.e. the side to which a ballast is typically mechanically connected to ensure machine stability). In the embodiment illustrated in FIG. 1, predefined access point 3A and walkway surface 7 are arranged along one of the side panels of upper structure 3.

As aforementioned, predefined access point 3A is configured to allow a person, typically a service technician, to gain access to upper structure 3, in particular by using access means, e.g. a ladder 6A or a plurality of steps, sometimes integral with the casings of upper structure 3 itself. Predefined access point 3A should be understood, in a non-limiting sense, as a surface or a three-dimensional space through which a person can access upper structure 3. In the illustrated embodiment, the predefined access point is situated substantially along the perimeter of upper structure 3. Therefore, a person can gain access to predefined access point 3A by either using a given access means or directly from the ground.

By way of non-limiting example, predefined access point 3A integral with upper structure 3 may be:

- a surface of upper structure 3 whereon the person will have to rest his feet,
- a space volume that the person will have to cross with his whole body or some parts thereof (e.g. legs, chest, head) in order to gain access to suitable adjacent walkway surfaces,
- a three-dimensional space including, at least partly, the access means (e.g. said ladder 6A); and
- the surface of the access means itself.

Preferably, predefined access point 3A may be a volume—in particular, adjacent to the access means (like ladder 6A)—internally comprising no elements or parts of foundation construction machine 1. For example, such volume is essentially an empty space intended to be crossed by the whole body or by some parts of the body of a person to provide access to one or more adjacent walkway surfaces.

In the illustrated embodiments, e.g. as shown in FIG. 1, upper structure 3 particularly comprises a control station 22 (in particular, a cabin) configured for internally receiving an operator, so that the latter can impart commands to foundation construction machine 1. Control station 22 comprises, in fact, actuation means (not numbered) allowing the operator to control the operation of foundation construction machine 1. Preferably, control station 22 includes signalling means (not numbered), e.g. a display and/or a flasher, configured to warn the operator about particular operating conditions of foundation construction machine 1. In some advantageous construction variants, the actuation means and the signalling means may be at least partly integrated into one assembly, e.g. forming a touchscreen device configured to allow the operator to control foundation construction machine 1 while at the same time displaying signals related to particular operating conditions of said foundation construction machine.

Preferably, each presence sensor 20 is mounted and oriented on upper structure 3 in a manner such that the respective monitoring region excludes those walkway surfaces through which said control station 22 is accessible. Thus, no presence sensor 20 will detect the presence of any solid bodies passing through a region allowing access to control station 22. In the embodiment illustrated in FIG. 1, the monitoring region of each presence sensor 20 and the associated walkway surface 7 are situated higher than control station 22, e.g. on top of upper structure 3.

Although in the embodiment illustrated in FIG. 1 predefined access point 3A and walkway surface 7 are situated along a side panel of upper structure 3, preferably near control station 22, in particular the cabin, so that they can be checked by the operator, it is to be understood that in other embodiments and construction variants said predefined access point 3A and said walkway surface 7 may be situated in different positions along the perimeter of upper structure 3. For example, predefined access point 3A and walkway surface 7 may be situated on the other side panel or on the front side or on the rear side.

Furthermore, although the embodiment illustrated in FIG. 1 shows a single predefined access point 3A and a single walkway surface 7, in further embodiments and construction variants upper structure 3 may include a plurality of predefined access points and/or a plurality of walkway surfaces. Such plurality of predefined access points and/or such walkway surfaces may be located, for example, along the same side panel, along both side panels or, more in general, along one or more sections of the perimeter of upper structure 3. In particular, the predefined access points may be adjacent to the same walkway surface 7, or the walkway surfaces may be adjacent to the same predefined access point. At any rate, for brevity and simplicity, the first embodiment shown in FIG. 1 will be described with reference to the single predefined access point 3A and the single walkway surface 7 illustrated therein; nevertheless, it is to be understood that the following description is also applicable to one or more other predefined access points and/or one or more adjacent walkway surfaces that may be included in other embodiments or construction variants of the present invention.

In the embodiment of FIG. 1, presence sensor 20 is shown mounted to the Diesel engine compartment, e.g. on top of the latter, by means of a support bracket. However, in further embodiments and construction variants, presence sensor 20 may, without distinction, be mounted to any other element integrally fixed to upper structure 3, e.g. casings, walkway surface 7, handrail, railing 8, cabin 22 or support brackets. Optionally, presence sensor 20 is mounted to one of railings 8 delimiting walkway surface 7 or directly on walkway surface 7. After properly orienting presence sensor and setting the characteristic parameters of its field of view (e.g. depth and angular width, or geometric outline with variable shape and depth depending on the angular position), the monitoring region may preferably coincide with the internal surface within the area delimited by railings 8 and above walkway surface 7 (e.g. an empty space or a surface containing only "air" which, for example, lies above walkway surface 7). In any case, any persons standing at a lower level, i.e. at the level where cabin 22 or, in general, a control station of foundation construction machine 1 can be accessed by walking on the track or on suitable lateral walkway surfaces, will not trigger the predetermined functions because they will not be detected by presence sensor 20. Vice versa, any persons climbing up to upper structure 3 from predefined access point 3A and accessing walkway surface 7 adjacent thereto will trigger the predetermined functions because they will be detected by presence sensor 20. Preferably, also a person accessing walkway surface 7 from the inside will be detected by presence sensor 20.

The following will describe, by way of example, some optional or preferred technical details of presence sensor 20.

In particular, presence sensor 20 is configured for detecting and/or receiving a signal (e.g. an electromagnetic radiation) within its field of view, for the purpose of monitoring the monitoring region integral with upper structure 3 within such field of view; preferably, said monitoring region coincides with the whole field of view of presence sensor 20, but it may nonetheless be freely configured to be limited to a part of the whole field of view of the sensor. By means of said signal, presence sensor is configured for detecting the presence of a solid body, e.g. a person (such as a service technician) within such monitoring region. Presence sensor 20 is further configured for sending a detection signal representative of the presence of said body. Preferably, the field of view of sensor 20, which may optionally be adjustable, has at least one of the following properties:

- a depth of field, i.e. a distance of view (optionally adjustable), of at least one meter (e.g. up to 4 meters),
- a horizontal field angle (optionally adjustable), i.e. the angular view aperture in a horizontal plane, of at least ° (e.g. up to 275°).

Optionally, the field of view has a variable spatial resolution, i.e. it is possible to set a different minimum size of the solid body, below which presence sensor 20 will not detect the presence of said body. The field of view of the sensor, and hence the monitoring region, may be either two-dimensional or three-dimensional and, in this latter case, the field of view will also have a vertical field angle, i.e. the angular view aperture in a plane perpendicular to the previously described horizontal plane.

Presence sensor 20 is preferably a sensor configured for detecting the position of a solid body within the monitoring region. For example, presence sensor 20 may be a laser scanner sensor adapted to emit infrared waves and receive such infrared waves reflected by a solid body that is present within the monitoring region. In particular, presence sensor 20 is configured for determining, based on the time elapsed between the emission of the laser beam and the reception of the reflected laser beam, the distance of the solid body from presence sensor 20 itself. As an alternative to a laser scanner sensor, presence sensor 20 may be any sensor based on electromagnetic waves, e.g. a lidar or radar sensor or a video camera, or any sensor based on sound waves, e.g. an ultrasonic sensor.

Presence sensor 20 is oriented in such a way that said monitoring region extends over walkway surface 7. In particular, the monitoring region may have a greater extension than the surface whereon the person must rest his feet, or may have an extension smaller than or equal to said walkway surface. However, the monitoring region always comprises walkway surface 7, and its extension is such that, when a person wants to gain access to winches 19 situated in proximity to walkway surface 7, said monitoring region must necessarily be crossed by at least some parts of the person's body. In further embodiments and construction variants, it is also conceivable that there are a plurality of presence sensors combinedly monitoring the monitoring region, wherein each one of such presence sensors is configured for monitoring only a respective part of the monitoring region including only a corresponding part of walkway surface 7; however, the plurality of presence sensors are so oriented that the combination of said respective parts of the monitoring region entirely covers walkway surface 7 adjacent to predefined access point 3A.

The following will describe, by way of example, some optional or preferred technical details of control system 9, which apply to all embodiments and construction variants of the foundation construction machine of the present invention, although for simplicity the description of such technical features will only refer to the embodiment shown in FIG. 1.

In particular, control system 9 of foundation construction machine 1 may be physically installed on the machine. In further embodiments and construction variants, control system 9 may be installed, at least partly, in a remote location and operatively connected to presence sensor to receive the detection signal.

With reference to the preferred configuration shown in FIG. 2, control system 9 comprises an electronic processing system 11 (e.g. an FPGA or a microcontroller or a CPU or a DSP), connected to presence sensor 20, and a central control unit 12 (e.g. a PLC), electrically connected to electronic processing system 11.

Preferably, electronic processing system 11 is connected to presence sensor 20 by means of a communication bus 13, e.g. a CAN bus. Alternatively, electronic processing system 11 is connected to presence sensor 20 by means of a dedicated communication channel.

Preferably, central control unit 12 is connected to electronic processing system 11 via a dual-channel connection, i.e. in such a way that electronic processing system 11 and central control unit 12 can mutually transmit a signal over two electric connections.

In the embodiment illustrated herein with reference to FIG. 2, foundation construction machine 1 also comprises, by way of example, a braking device 14, e.g. a mechanical brake or an electric motor control device or an overcenter valve, an alarm device 24, e.g. a siren or a buzzer, and a starting circuit 15 for starting foundation construction machine 1. Braking device 14, alarm device 24 and starting circuit 15 are operatively connected to central control unit 12, possibly by means of suitable hydraulic or electric control systems.

The following will describe in more detail some optional or preferred technical features of the means and modes implemented by central control unit 12 for processing the detection signal.

When sensor 20 detects the presence of a solid body, e.g. the presence of a person, within the monitoring region, it sends to electronic processing system 11, over communication bus 13, the detection signal representative of such presence. The transmission of the detection signal to electronic processing system 11 is effected, for example, by using a communication protocol configured with diagnostic mechanisms, e.g. the CANopen Safety protocol, in order to identify any errors in the communication of such detection signal (e.g. excessive transmission delays or lost parts of the information being transmitted by such signal). Such diagnostic mechanisms may envisage, merely by way of example, the transmission of a progressive number acting as a counter, which is incremented every time a signal is exchanged, or the use of a timestamp certifying the transmission of the detection signal or the time elapsed between the transmission of two successive detection signals or, anyway, any configuration of the communication protocol which is adapted for detecting any communication errors in the information sent by presence sensor 20 to electronic processing system 11 by means of the detection signal.

In particular, electronic processing system 11 is configured for processing the detection signal, e.g. by means of a program loaded in a memory unit of electronic processing system 11 itself. Also, electronic processing system 11 is configured for sending to central control unit 12 a command signal generated on the basis of such processing. For example, the program loaded in electronic processing system 11 may divide the entire monitoring region of sensor 20 into a severe alarm sub-region, closer to the dangerous zone, and a pre-alarm sub-region, farther from the dangerous zone, and may process the detection signal in order to determine the position of the solid body, thus determining if the detected solid body (i.e. the detected person) is within the pre-alarm sub-region and/or within the severe alarm sub-region. Regardless of whether the solid body is detected in the pre-alarm sub-region and/or in the severe alarm sub-region of the monitoring region, electronic processing system 11 is configured to send the command signal to central control unit 12.

Preferably, if the solid body (i.e. the person) is detected within the severe alarm sub-region, the command signal will be transmitted to central control unit 12 via a dual-channel connection; on the contrary, the control signal will be transmitted to central control unit 12 via a single-channel connection if the solid body is detected within the pre-alarm sub-region.

In the embodiment illustrated herein with reference to FIG. 2, central control unit 12 is configured for receiving the command signal and for sending, as a function of the received command signal, one or more control signals to one or more devices or components of foundation construction machine 1 in order to have such devices or components execute one or more predetermined functions, when the detection signal is representative of the presence of a solid body in proximity to walkway surface 7. Preferably, such control signal(s) is (are) sent with priority over the commands issued by the operator of foundation construction machine 1, so as to cause said machine to execute some predetermined functions.

The following will describe in more detail some optional or preferred technical features related to the predetermined functions that can be caused to be executed by means of the control signal output by control system 9 as a function of the received detection signal.

In particular, if the solid body (i.e. the person) is detected within the monitoring region (e.g. within the severe alarm sub-region), control system 9 may be configured for transmitting a control signal intended to cause foundation construction machine 1 to execute at least one predetermined function selected from a group of predetermined functions including:

- emitting one or more alarm signals,
- preventing at least one part, component or device of foundation construction machine 1 from moving, if this is not dangerous.

By way of example, the control signal may be intended to be sent, via suitable hydraulic and/or electric control circuits, to braking device 14.

In one embodiment, braking device 14, configured for receiving the control signal, is configured for preventing winch 19 mounted on upper structure 3 from moving. Of course, this motion prevention will only be automatically effected if it does not lead to the onset of additional dangerous situations. In particular, the control signal is transmitted to an overcenter valve and/or an electric motor control device and/or a mechanical parking brake of braking device 14, so as to prevent the drum of winch 19 from turning when sensor 20 detects a solid body within the monitoring region.

According to further embodiments and construction variants, braking device 14 may be configured for preventing a rotation of upper structure 3 relative to self-moving or mobile assembly 2. In this case as well, such motion prevention will only be automatically effected if it does not lead to the onset of additional dangerous situations. In particular, the control signal is transmitted to an overcenter valve and/or an electric motor control device and/or a mechanical parking brake of braking device 14, so as to prevent any relative rotation between upper structure 3 and self-moving or mobile assembly 2.

Preferably, according to particular construction variants of the present invention, braking device 14 is configured for effecting said motion prevention by preventing winch 19 from moving and/or upper structure 3 from rotating upon receiving said control signal due to the presence of the solid body within the monitoring region of presence sensor 20. In other words, if a solid body is detected within the monitoring region, it will be impossible to start winch 19 and/or to turn upper structure 3, which will thus remain stationary, without moving at all. In such particular construction variants, when presence sensor 20 detects the solid body in the monitoring region, if winch 19 and/or upper structure 3 have already been operated and/or are already in motion, it will generally be appropriate to avoid any automatic intervention by braking device 14; in such a condition, in fact, any automatic intervention would threaten to introduce additional risks in the operation of foundation construction machine 1, particularly because of the high forces involved and/or the high speeds of the various components when in operation. Optionally, in other different construction variants, if construction machine 1 is operating with moderate dynamics (e.g. low forces and/or speeds), it is possible to take into account some criteria for controlling the automatic intervention of braking device 14 to provide a gradual stopping action, e.g. controlled braking as opposed to a sudden stop of the components, and without turning off the machine.

According to further embodiments and construction variants, the control signal may be sent to a starting circuit 15 of foundation construction machine 1, e.g. to a safety relay.

If the detection signal is representative of a person that is present in the pre-alarm sub-region of the monitoring region, the control signal may be sent to one or more alarm devices 24 in order to emit one or more alarm signals perceivable by an operator of said foundation construction machine. In particular, when a person is within the pre-alarm sub-region, the alarm signal emitted by one or more alarm devices 24 will consist of one or more pop-up windows appearing on a display installed in the operator's control station 22 or cabin.

If the detection signal is representative of a person that is present in the severe alarm sub-region of the monitoring region, the control signal may be sent to one or more alarm devices 24 in order to generate an audible and/or visual alarm. For example, the audible alarm may comprise the sound emitted by a buzzer, advantageously one that cannot be silenced. Moreover, for example, the visual alarm may include luminous and blinking signals (e.g. blinking indicators and/or alarm pop-up windows shown on a display installed in control station 22 or cabin). The audible alarm and/or the visual alarm are configured to be clearly audible and/or visible to the machine operator sitting in the operator's control station 22 or cabin and, preferably, also to the person within the monitored region.

Optionally, in the severe alarm sub-region other previously described predetermined functions may be executed in addition to the emission of one or more of the above-described alarms. It will be appreciated, therefore, that in the preferred case, wherein the pre-alarm sub-region is farther from the dangerous zone and the severe alarm sub-region is closer to it, a person entering the pre-alarm sub-region will cause the appearance of a pop-up window on a display in the operator's control station 22 or cabin while, should that person move closer and enter the severe alarm sub-region, this will imply the emission of one or more audible and/or visual alarms. Optionally, the entry of a person in the severe alarm sub-region may also cause some parts of foundation construction machine 1 to be prevented from moving, provided that this creates no additional dangers.

As mentioned above, in principle, the control signal sent by control system 9 causes foundation construction machine 1 to automatically execute at least one predetermined function, without requiring the manual intervention of the machine operator. Following the execution of the predetermined function(s), control system 9 may allow restoring the normal operability of foundation construction machine 1 by stopping the execution of the predetermined function(s), interrupting the alarm and/or operating and/or moving the machine and parts thereof, if a solid body is no longer detected within the area being monitored by presence sensor 20. Preferably, such restoral of the normal operability will be allowed by control system 9 in a semi-manual manner, i.e. control system 9 will only allow the operator to manually stop the execution of the predetermined function(s) if presence sensor 20 is no longer detecting a solid body within the monitoring region.

Preferably, electronic processing system 11 is configured to detect a fault of at least one of presence sensor 20 and electronic processing system 11 itself, e.g. a power interruption or a malfunction of internal chips, and is further configured to cause foundation construction machine 1 to execute at least one of the above-described predetermined functions when it detects such a fault.

Optionally, electronic processing system 11 is configured to temporarily suspend the detection of the presence of a solid body by presence sensor 20 by means of a deactivation signal sent to presence sensor 20 over communication bus 13. For example, in order to temporarily suspend such detection, it can be envisaged to use a key selector for overriding the sensor; in particular, such selector may be used during operations that do not require the machine to be normally operational, e.g. operations necessary for replacing the rope, with foundation construction machine 1 typically having its mast arranged horizontal or quasi-horizontal.

In addition, electronic processing system 11 may be configured to execute an initial memorization of the solid bodies initially detected by presence sensor 20 within the monitoring region, e.g. following an initial detection of the positions of any solid bodies to be considered as normally present within the monitoring region (e.g. machine parts, railings and walkway surfaces), and is configured to send the command signal to central control unit 12 when, after such initial memorization, presence sensor 20 detects, within the monitored zone, a solid body other than the previously stored solid bodies.

Figure 3:
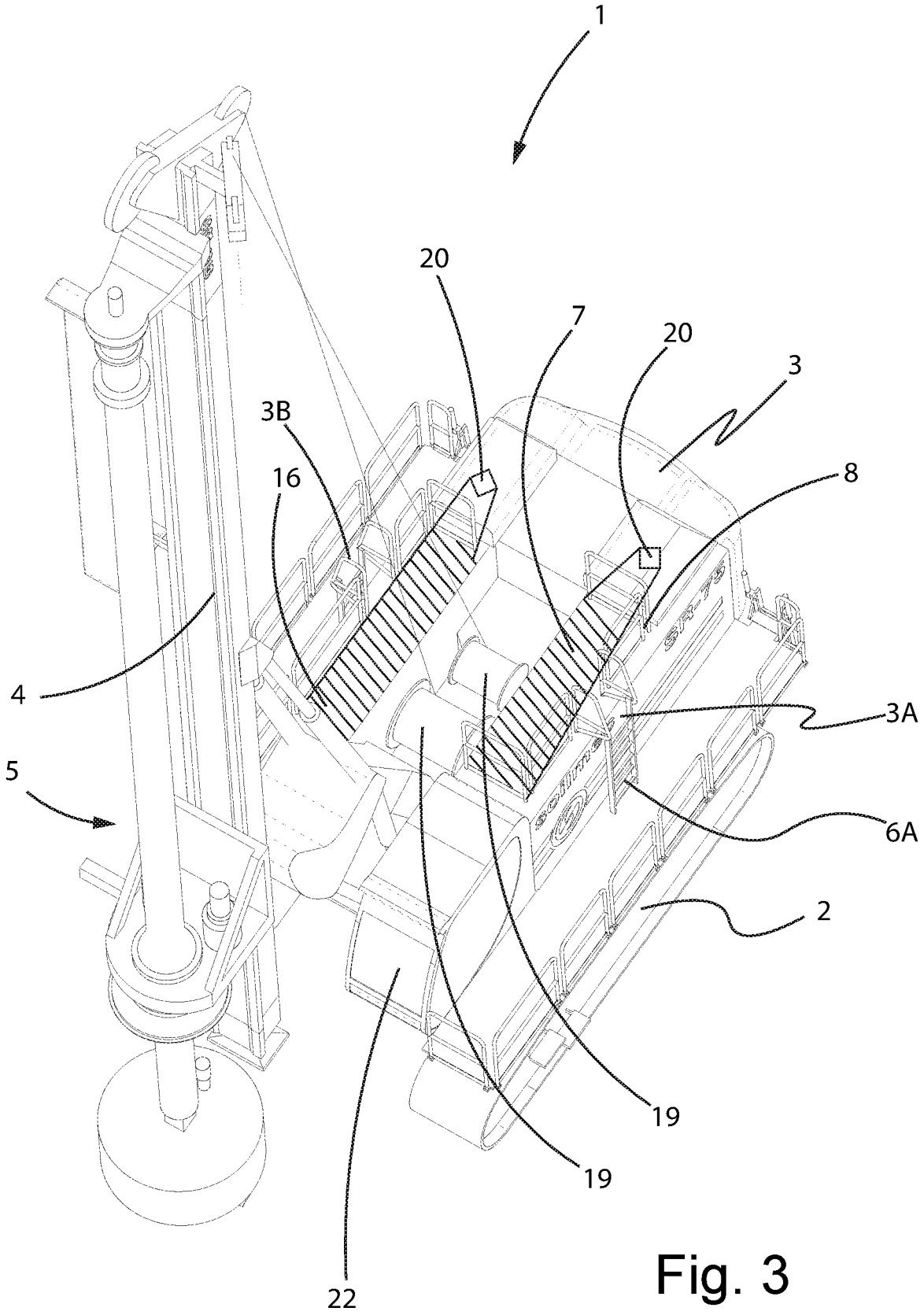
FIG. 3 is a perspective top view of a foundation construction machine made in accordance with a construction variant of the first embodiment of the present invention.

With reference to FIG. 3, the following will describe foundation construction machine 1 made in accordance with a construction variant of the first embodiment.

Those parts and elements which are similar to—or which perform the same function as—those of the above-described embodiment and construction variant have been assigned the same alphanumerical references. For brevity, the description of such parts and elements will not be repeated below, and reference should be made to the above description.

In particular, upper structure 3 of foundation construction machine 1 shown in FIG. 3 is equipped with a predefined access point 3A, similar to the one described with reference to FIG. 1, and with an additional predefined access point 3B, situated substantially along the perimeter of upper structure 3, configured to allow a person to gain access to upper structure 3, and adjacent to an additional walkway surface 16. In the embodiment illustrated in FIG. 3, the additional predefined access point 3B and the additional walkway surface 16 are located along one of the side panels of upper structure 3, in particular along the side panel opposite the one along which the predefined access point 3A and walkway surface 7 are located. As regards the additional predefined access point 3B and the additional walkway surface 16, the same description previously made with reference to the predefined access point 3A and walkway surface 7 applies. In the construction variant shown in FIG. 3, in addition to a first presence sensor 20 wholly identical to the one already described with reference to FIG. 1, there is also a second presence sensor 20 mounted near additional walkway surface 16, whose monitoring region covers additional walkway surface 16. Preferably, the second presence sensor 20 is identical to the first presence sensor e.g. they are both laser scanner sensors; nevertheless, they may also be of different types, e.g. a laser scanner and a radar. Irrespective of the sensor type, the function of the second presence sensor 20 is wholly similar to the function of the first presence sensor 20 described with reference to FIG. 1. In particular, both sensors are configured for detecting the presence of a solid body within the respective monitoring region and are operationally connected to control system 9 by means of two mutually independent connections or via a common communication bus 13. Thus, when the first sensor 20 detects the presence of a solid body within its monitoring region, e.g. a service technician accessing walkway surface 7, and/or when second sensor 20 detects the presence of a solid body within the respective monitoring region, e.g. a service technician accessing additional walkway surface 16, central control unit 12 will send one or more control signals to one or more devices or components of foundation construction machine 1 in order to have such devices or components execute one or more predetermined functions as previously described. It should be understood, therefore, that everything already described with reference to FIG. 1 also applies to the second presence sensor 20.

Figure 4:
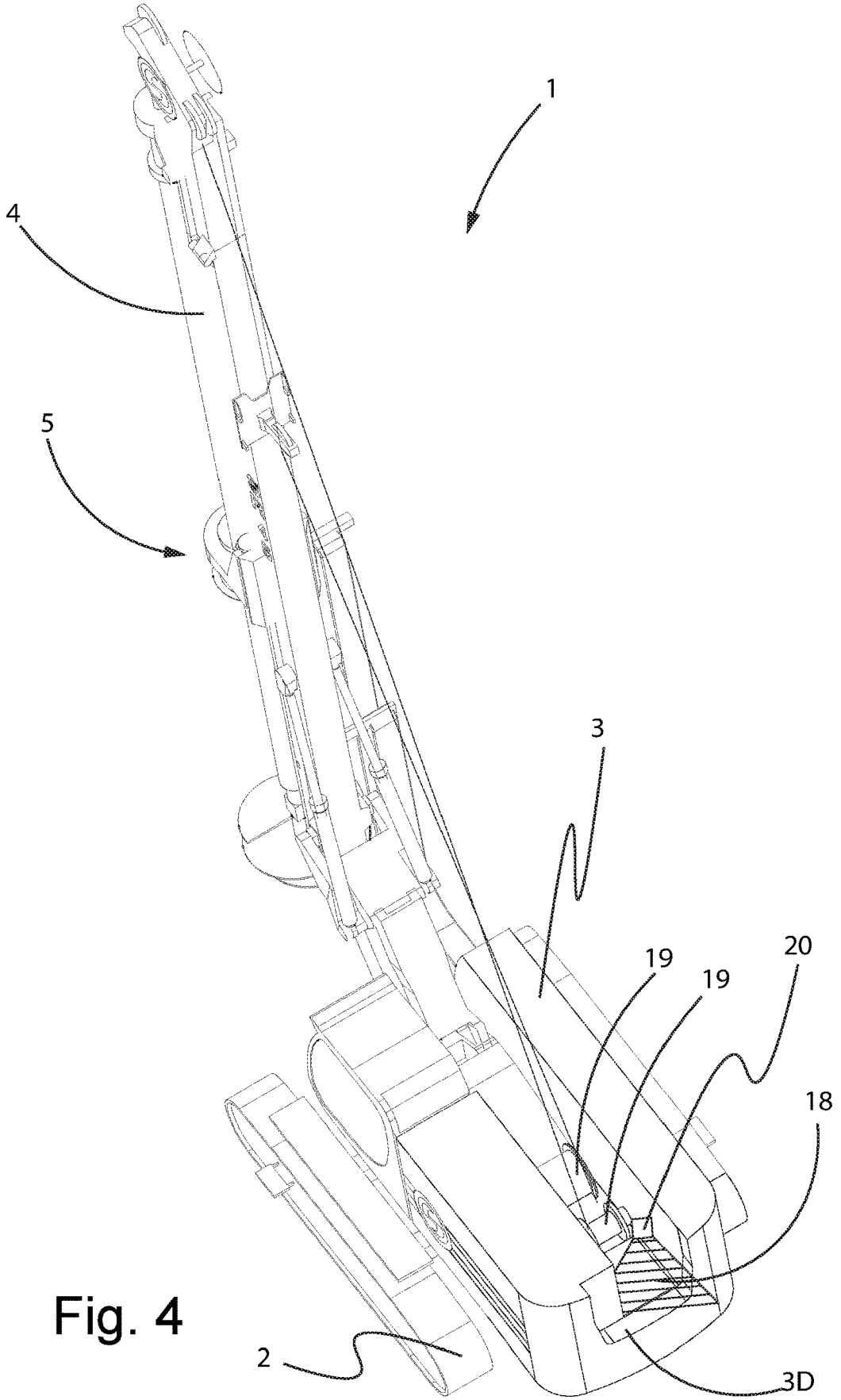
FIG. 4 is a perspective top view of a foundation construction machine made in accordance with a further construction variant of the first embodiment of the present invention.

With reference to FIG. 4, the following will illustrate foundation construction machine 1 made in accordance with a further construction variant of the first embodiment.

Those parts and elements which are similar to—or which perform the same function as—those of the above-described embodiment and construction variant have been assigned the same alphanumerical references. For brevity, the description of such parts and elements will not be repeated below, and reference should be made to the above description.

In particular, upper structure 3 of foundation construction machine 1 shown in the drawing is equipped with an independent predefined access point 3D configured to allow a person to gain access to upper structure 3 from its rear or tail side, e.g. by simply climbing up to upper structure 3 directly from the ground by using available access means (e.g. access ladders). In particular, independent predefined access point 3D allows a service technician to gain access to an independent walkway surface 18 of upper structure 3; for example, from independent walkway surface 18 it is possible to access components of foundation construction machine 1 that need to be inspected and serviced, e.g. winches 19. In particular, independent walkway surface 18 is adjacent to independent predefined access point 3D and is situated in a substantially central position.

To upper structure 3 a presence sensor 20 is integrally mounted, which is configured for detecting the presence of a solid body within a monitoring region and which is so oriented that such monitoring region covers independent walkway surface 18. In FIG. 4, in particular, presence sensor 20 is mounted on independent walkway surface 18; in further construction variants, however, presence sensor 20 may be mounted to any element integral with independent walkway surface 18, e.g. the casings of upper structure 3 or the rear ballast elements or the railings. In any case, any persons moving at the lower level, i.e. the level where control station or cabin 22 can be accessed by walking on the track or on suitable lateral walkway surfaces, or on the ground whereon machine 1 lies, will not trigger the predetermined functions because they will not be detected by presence sensor 20.

Although the construction variant of FIG. 4 shows a single independent predefined access point 3D, it is also conceivable that there are a plurality of independent predefined access points along the rear side and/or along the front side of the machine.

In the construction variant illustrated in FIG. 4, control system 9 is operationally connected to presence sensor 20, preferably via a communication bus 13, so as to be configured for receiving from sensor 20 the detection signal representative of the presence of a solid body. It should therefore be understood that control system 9 is configured to cause foundation construction machine 1 to execute the predetermined function(s) when said presence sensor 20 detects a solid body on the respective independent walkway surface 18.

Figure 5:
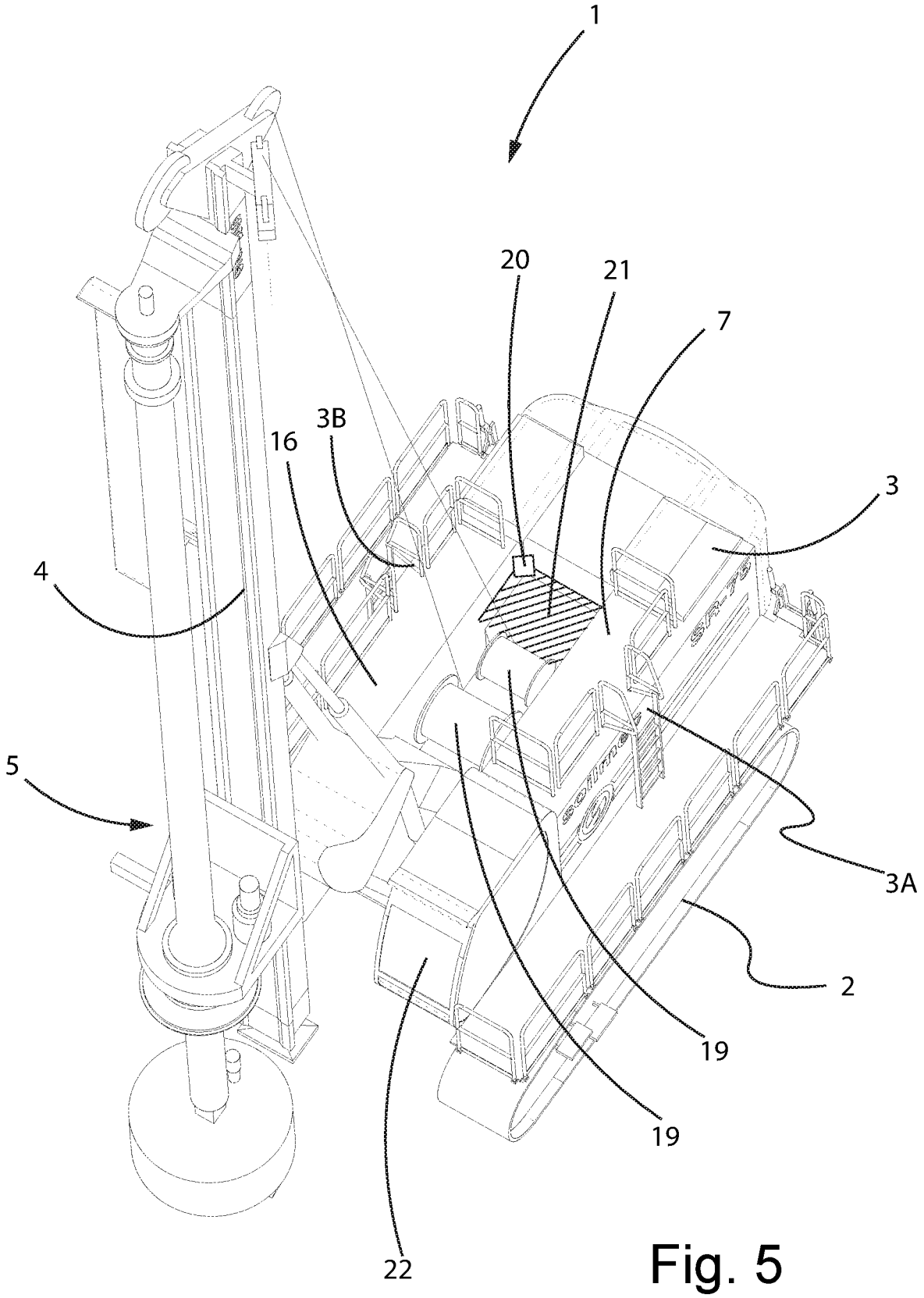
FIG. 5 is a perspective top view of a foundation construction machine made in accordance with a further construction variant of the first embodiment of the present invention.

With reference to FIG. 5, the following will illustrate foundation construction machine 1 made in accordance with another construction variant of the first embodiment of the present invention. Those parts and elements which are similar to—or which perform the same function as—those of the above-described embodiment have been assigned the same alphanumerical references. For brevity, the description of such parts and elements will not be repeated below, and reference should be made to the above description. Unlike the previous example, FIG. 5 shows a presence sensor 20 mounted integrally with upper structure 3, so oriented and configured as to monitor a monitoring region integral with upper structure 3 and covering a walkway surface 21 which is not adjacent to a predefined access point 3A, 3B that allows access to upper structure 3, so as to detect the presence of a solid body in such monitoring region and send a detection signal representative of the presence of such solid body. By way of example, in FIG. 5 walkway surface 21 corresponds to a treadable surface in proximity to at least one winch 19 to be inspected and serviced by a service technician. In particular, walkway surface 21 is a walkway surface internal to upper structure 3, and is not arranged substantially along the perimeter of upper structure 3, but internally thereto, being substantially delimited by casings, doors or components housed on upper structure 3. Therefore, a service technician can only gain access to walkway surface 21 by using access means available inside upper structure 3, e.g. an internal ladder or internal steps or internal doors, or anyway by overcoming a difference in height and/or a discontinuity existing between walkway surface 21 and walkway surface 7 or additional walkway surface 16 respectively adjacent to the predefined access points 3A and 3B. Although FIG. 5 shows a single presence sensor 20, it is also conceivable that there are a plurality of presence sensors combinedly monitoring the monitoring region, wherein each one of such presence sensors is configured for monitoring only a part of the monitoring region including only a corresponding part of non-adjacent walkway surface 21; however, the plurality of presence sensors is oriented in a manner such that said respective parts of the monitoring region fully cover, as a whole, walkway surface 21 that is not adjacent to a predefined access point that allows access to upper structure 3.

Figure 6:
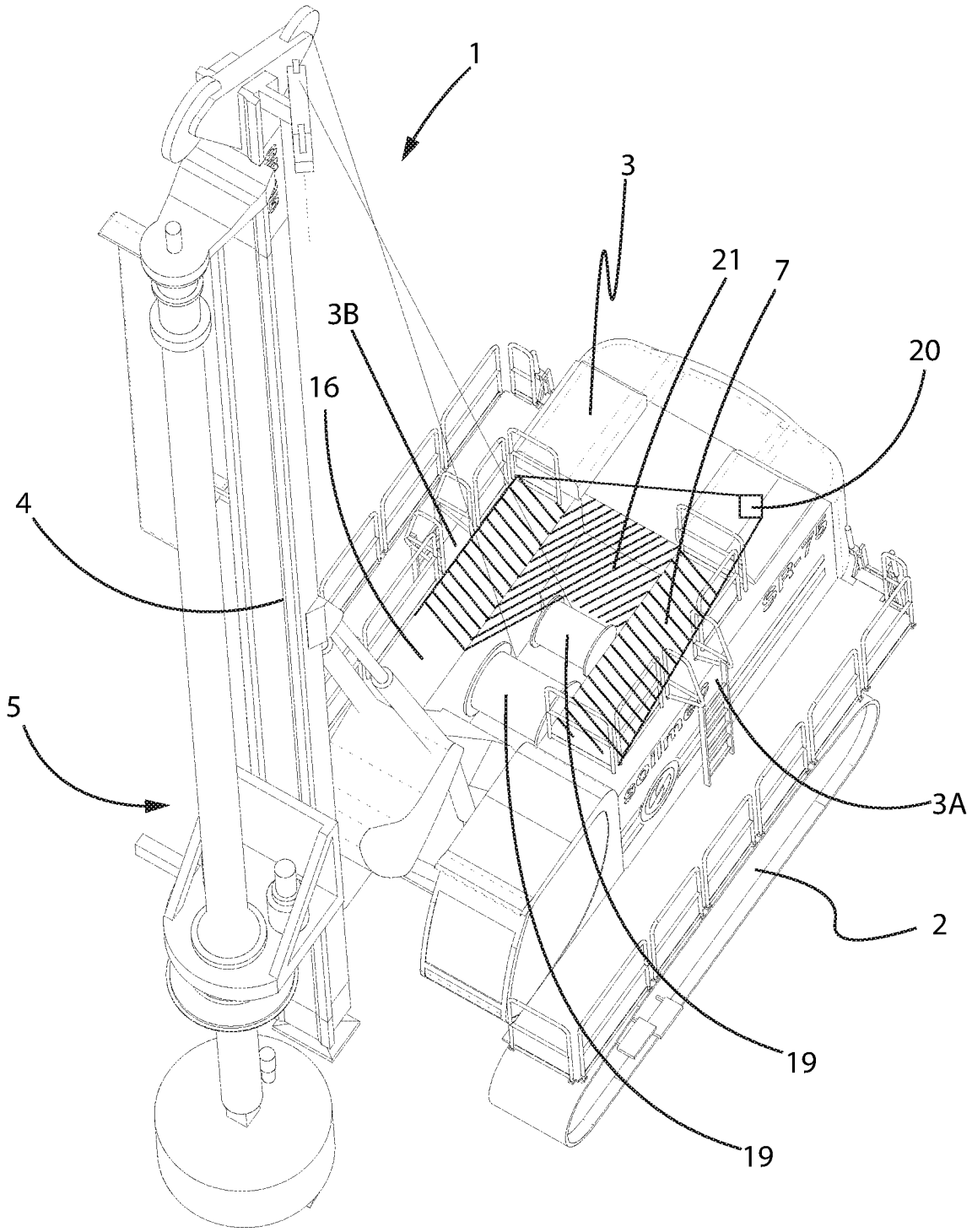
FIG. 6 is a perspective top view of a foundation construction machine made in accordance with a second embodiment of the present invention.

With reference to FIG. 6, a foundation construction machine designated as a whole as 1 is made in accordance with a second embodiment of the present invention. It should be understood that the second embodiment may comprise, in addition or as an alternative, everything already described with reference to the first embodiment and the variants and combinations thereof, i.e. the second embodiment can be freely combined with what has been previously described herein. Those parts and elements which are similar to—or which perform the same function as—those of the first embodiment and variants thereof as previously described have been assigned the same alphanumerical references. For brevity, the description of such parts and elements will not be repeated below, and reference should be made to the above description. Moreover, the following will only describe those features which are additional or alternative to those of the first embodiment and its construction variants, and everything previously described still applies and remains unchanged. In fact, the features of the foundation construction machine according to the second embodiment can be freely combined with the features illustrated and described with reference to the first embodiment (and its construction variants). Unlike the previous example, FIG. 6 shows a presence sensor 20 integrally mounted to upper structure 3, so oriented and configured as to monitor a monitoring region integral with upper structure 3 and covering a plurality of walkway surfaces, in particular covering walkway surface 7, which is adjacent to predefined access point 3A, additional walkway surface 16, which is adjacent to additional predefined access point 3B, and also walkway surface 21, which is not adjacent to a predefined access point that allows access to upper structure 3, so as to detect the presence of a solid body in such monitoring region. In particular, after properly orienting presence sensor 20 and setting the characteristic parameters of its field of view (e.g. depth and angular width), the monitoring region will include no object belonging to foundation construction machine 1 and will remain above walkway surface 7 or 16 (e.g. the monitoring region may be an empty space or a surface containing only "air", e.g. situated 50-700 mm above walkway surface 7). Advantageously, the field of view and the monitoring region of presence sensor 20 are freely adjustable via software by means of electronic processing system 11; for example, it is possible to set a variable field depth within the monitoring region in order to adapt the monitoring region to the particular geometry of upper structure 3. Presence sensor 20 can detect the presence of a solid body in said monitoring region and is further configured for sending to control system 9 a detection signal representative of the presence of said solid body, so that control system 9 will cause foundation construction machine 1 to execute one or more predetermined functions, as previously described, when the detection signal is representative of the presence of a solid body in proximity to any walkway surface 7, 16 that is adjacent to a predefined access point 3A, 3B and/or in proximity to any walkway surface 21 that is not adjacent to a predefined access point allowing access to upper structure 3. It should therefore be understood that the second embodiment of the present invention teaches to adopt at least one presence sensor 20 so oriented and configured as to monitor a monitoring region integral with said upper structure 3 and covering a plurality of walkway surfaces 7, 16, 18, 21. In the particular configuration of FIG. 6, such monitoring region covers one or more walkway surfaces adjacent to the predefined access points that allow access to upper structure 3 and also one or more non-adjacent walkway surfaces, i.e. arranged inside upper structure 3. In particular, such monitoring activity can be effected by means of a single presence sensor 20 whose field of view covers the whole desired monitoring region (as shown in FIG. 6), resulting in a considerable simplification of the installations; therefore, this is one of the preferred solutions. Alternatively, such monitoring activity may be effected by means of a plurality of presence sensors 20, each one configured for monitoring only a part of the whole desired monitoring region, and each one so oriented that the respective parts of the monitoring region will fully cover, as a whole, the desired monitoring region, i.e. walkway surfaces 7, 16 adjacent to the corresponding predefined access points 3A, 3B and walkway surface 21 that is not adjacent to a predefined access point allowing access to upper structure 3.

Figure 7:
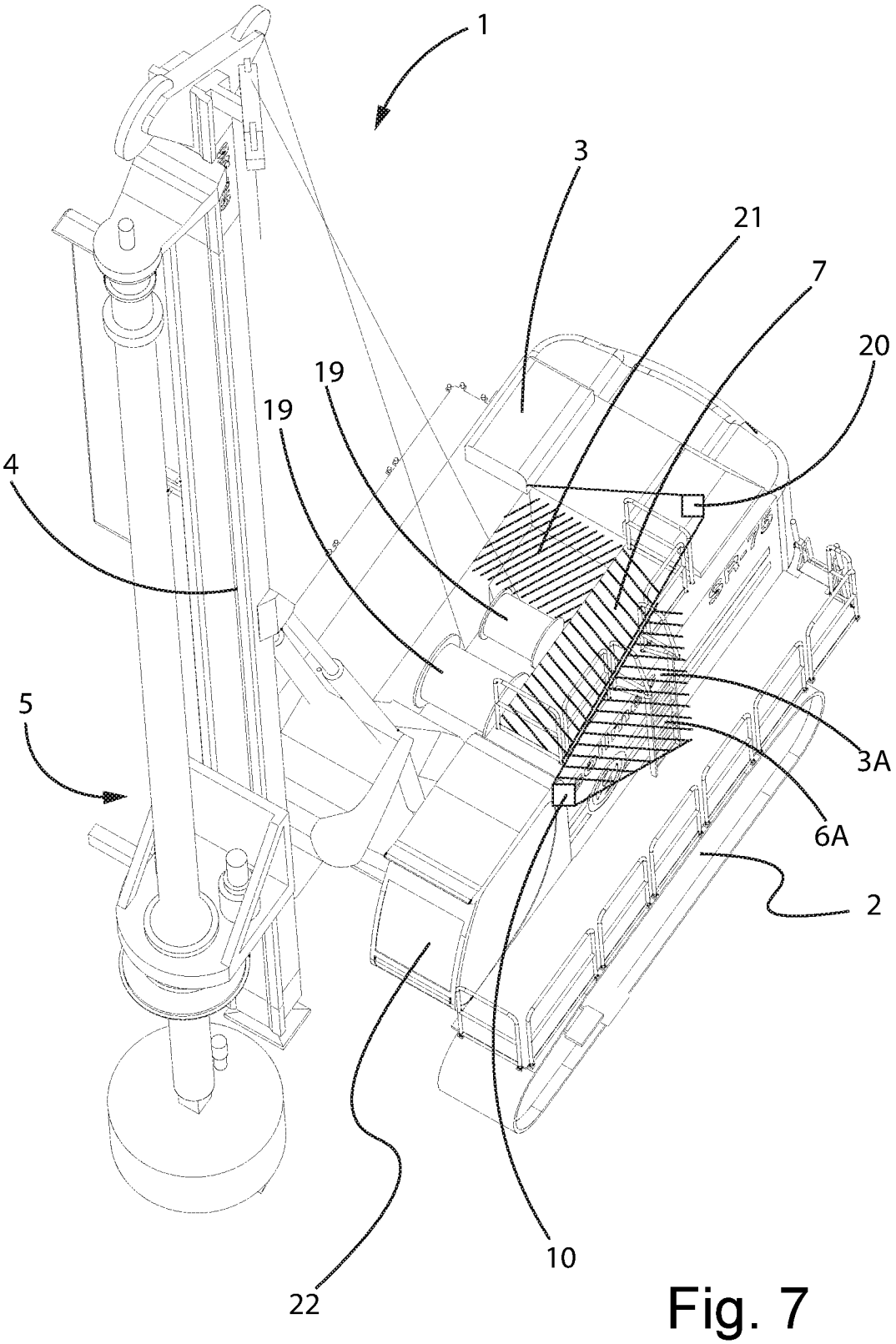
FIG. 7 is a perspective top view of a foundation construction machine made in accordance with a third embodiment of the present invention.

With reference to FIG. 7, the following will illustrate foundation construction machine 1 made in accordance with a third embodiment of the present invention. It should be understood that the third embodiment may comprise, in addition or as an alternative, what has already been described with reference to the first and second embodiments and their variants and combinations, i.e. the third embodiment can be freely combined with the previous examples.

Those parts and elements which are similar to—or which perform the same function as—those of the previously illustrated embodiments and construction variants have been assigned the same alphanumerical references. For brevity, the description of such parts and elements will not be repeated below, and reference should be made to the above description. Moreover, the following will only describe those features which are additional or alternative to those of the first and second embodiments and their construction variants, and everything previously described still applies and remains unchanged. In fact, the features of the foundation construction machine according to the third embodiment can be freely combined with the features illustrated and described with reference to the first and second embodiments (and their construction variants).

Unlike the previous examples, the third embodiment shown in FIG. 7 relates to a foundation construction machine 1 comprising also, in addition to at least one presence sensor 20 as previously described, an access sensor 10 integrally mounted to upper structure 3, so oriented and configured as to monitor a monitoring region integral with upper structure 3 and including the predefined access point 3A. Access sensor 10 has optional or preferred technical features that are equal or similar to those already illustrated in the description of presence sensor 20, to which reference should be made, possibly with a different physical principle of operation of the sensor and/or different values of the characteristic parameters of its field of view. In particular, access sensor 10 may be of the same type as presence sensor 20, e.g. both of them are laser scanner sensors, or it may be of a different type, e.g. presence sensor 20 is a laser scanner and access sensor 10 is a radar; at any rate, access sensor 10 can detect the presence of a solid body in the corresponding monitoring region and send a detection signal representative of the presence of the solid body. Access sensor 10 is connected to control system 9 in a way similar to that already described with reference to presence sensor 20, in order to cause foundation construction machine 1 to execute one or more predetermined functions, as previously described, when the detection signal is representative of the presence of a solid body in proximity to predefined access point 3A. After properly orienting access sensor 10 and setting the characteristic parameters of its field of view (e.g. depth and angular width), the monitoring region may coincide with an external space adjacent to ladder 6A of the predefined access point 3A and/or with an internal space facing walkway surface 7. Preferably, the internal space is located inside the zone delimited by railings 8, whereas the external space remains outside the zone delimited by railings 8 and, in both cases, such spaces are located above railing 8 and/or above walkway surface 7 (e.g. an empty space or a volume or a surface containing only "air"). In any case, any persons moving at the lower level, i.e. the level where access can be gained to control station 22 by walking on the track or on suitable lateral walkway surfaces, will not trigger the predetermined functions because they will not be detected by access sensor 10. Vice versa, any persons climbing up to upper structure 3 from the predefined access point 3A will trigger the predetermined functions because they will be detected by access sensor 10. Optionally, also a person walking internally on walkway surface 7 can be detected by access sensor 10. Access sensor 10 is so oriented that said monitoring region includes the predefined access point 3A. In particular, the monitoring region may have a greater extension than the surface whereon the person must rest his feet or the volume that a person must cross with his whole body, or it may have an extension smaller than or equal to said surface or volume. However, the monitoring region always comprises the predefined access point 3A, and its extension is such that, when a person wants to gain access to suitable walkway surface 7 adjacent to the predefined access point 3A that allows access to upper structure 3, said monitoring region must necessarily be crossed by at least some parts of the person's body. It should therefore be understood that said access sensor 10 may differ from presence sensor 20 only in the different orientation of its field of view, so that the monitoring region monitored by access sensor 10 extends over the predefined access point 3A instead of covering walkway surface 7 adjacent thereto. In further embodiments and construction variants, it is also conceivable that there are a plurality of access sensors 10 monitoring, as a whole, the monitoring region including predefined access point 3A, wherein each one of such access sensors 10 is configured for monitoring only a part of the monitoring region including only a corresponding part of the predefined access point 3A; however, the plurality of access sensors 10 are so oriented that, taken together, said respective parts of the monitoring region will totally include the predefined access point 3A. Although FIG. 7 shows a single predefined access point 3A, in further construction variants there may be a plurality of predefined access points 3A, 3B, 3D (as previously described), each one being monitored by one or more access sensors 10. Control system 9 is therefore operationally connected to each access sensor 10 and each presence sensor 20 to receive their detection signals, and is configured for sending a control signal intended to cause foundation construction machine 1 to execute at least one predetermined function when at least one of access sensors 10 or at least one of presence sensors detects the presence of a person in proximity to any predefined access point 3A, 3B, 3D allowing access to upper structure 3 or any walkway surface 7, 16, 18 adjacent to the predefined access points 3A, 3B, 3D or any walkway surface 21 not adjacent to the predefined access points. Preferably, the predetermined functions executed by foundation construction machine 1 are always the same, regardless of whether the detection signal is received from an access sensor 10 or from a presence sensor 20, e.g. in both cases an alarm signal will be emitted. Optionally, however, the predetermined functions executed by foundation construction machine 1 may be different depending on whether the detection signal is received from an access sensor 10 or from a presence sensor 20 and/or depending on whether the solid body is detected within a severe alarm sub-region or within a pre-alarm sub-region of the monitoring regions of access sensors 10 and of presence sensors 20. Furthermore, although in FIG. 7 access sensor 10 is shown mounted to cabin 22, e.g. on top of it by means of a support bracket, in further construction variants access sensor 10 may indifferently be mounted to any other member integrally fixed to upper structure 3, e.g. casings, walkway surface 7, handrail, railing 8 or support brackets.

Figure 8B:
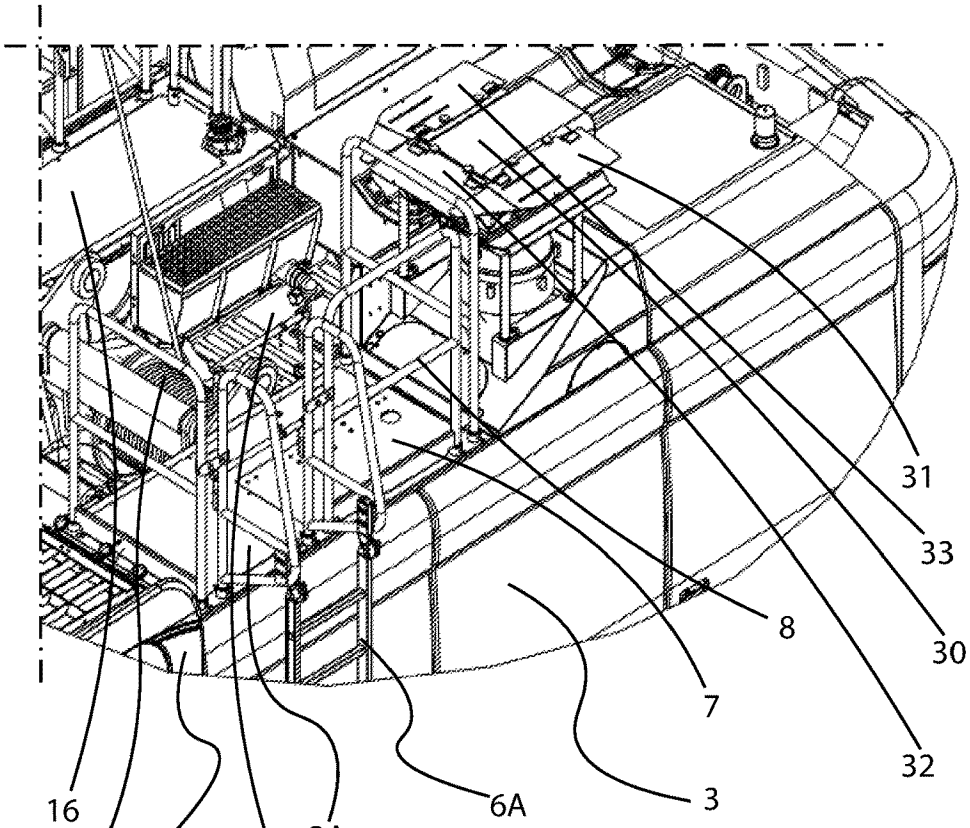
FIGS. 8-*a*, 8-*b* show some details of the foundation construction machine of the present invention, illustrating a preferred installation configuration of a presence sensor and its protective cover.
Figure 8A:
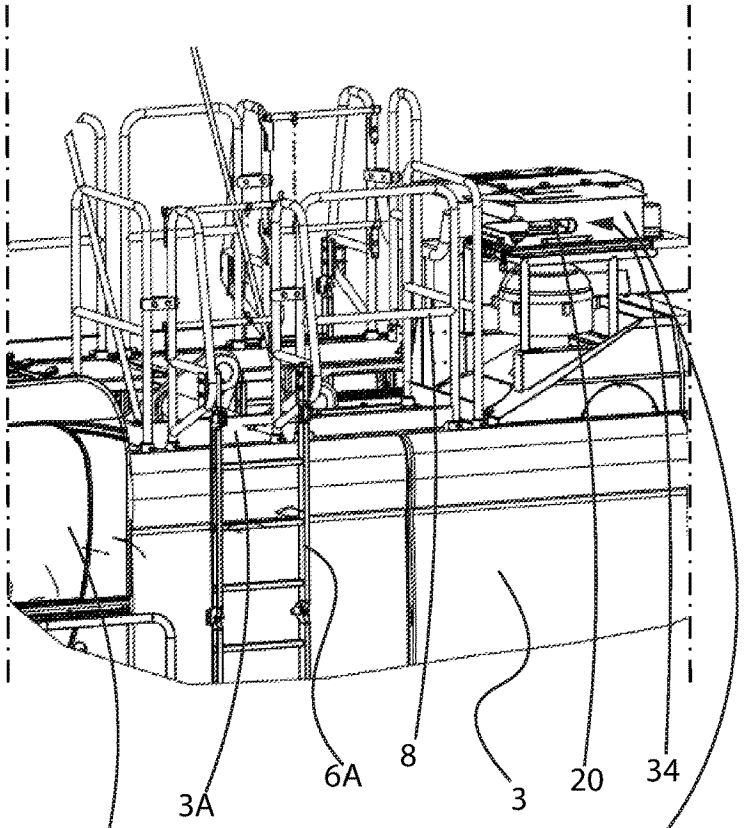

With reference to FIGS. 8-*a*, 8-*b*, the following will illustrate in detail a preferred installation configuration of a presence sensor 20 on foundation construction machine 1 of the present invention. Such preferred installation configuration applies to all of the above-described embodiments and construction variants, or combinations thereof. In such preferred configuration, presence sensor 20 is mounted under or inside a guard or cover 30, mechanically connected to upper structure 3 in a fixed or removable manner, for the purpose of protecting presence sensor 20 when operating under severe environmental conditions, e.g. heavy rain or snow. Cover 30, preferably having a boxed shape and made of sheet steel, is provided with a lateral slot or aperture 34 of appropriate height and shape, through which the electromagnetic radiation emitted by presence sensor 20 can pass, so that said presence sensor 20 can monitor the monitoring region without cover 30 representing a physical hindrance to the emission and/or propagation of the electromagnetic radiation from presence sensor 20. Preferably, cover 30 is also equipped with lateral fins 31, 32, 33 that protrude on the sides of the box, within or under which presence sensor 20 is arranged, which fins have a suitable width and can be folded about hinges to adjust their angle for adequately protecting presence sensor 20, preventing rain or snow subject to crosswinds from passing through aperture 34 and settling on presence sensor 20. Lastly, it will be appreciated that the preferred installation configuration described with reference to a presence sensor 20 can also be adopted, in the same or a similar manner, for access sensor 10, particularly when said access sensor 10 is a laser scanner.

The present invention also relates to a method for controlling a foundation construction machine 1; as previously described, foundation construction machine 1 comprises:

- a self-moving or mobile assembly 2 configured to move on the ground, thus moving the foundation construction machine 1;
- an upper structure 3, mechanically connected to said self-moving or mobile assembly 2, equipped with at least one predefined access point 3A, 3B, 3D configured to allow a person to gain access to said upper structure 3, and equipped with at least one walkway surface 7, 16, 18, 21;
- a mast or boom 4, mechanically connected to upper structure 3, whereon an operating equipment 5 is configured to be mounted in order to drill the ground;
- a control station 22 mechanically connected to said upper structure 3 and configured to issue commands for controlling foundation construction machine 1;
- at least one presence sensor 20 integrally mounted to upper structure 3, which is so oriented and configured as to monitor a monitoring region integral with said upper structure 3 and covering said at least one walkway surface 7, 16, 18, 21, said at least one presence sensor 20 being configured for detecting the presence of a solid body in said monitoring region and for sending a detection signal representative of the presence of said solid body;
- a control system 9 operationally connected to said at least one presence sensor 20;
- wherein said method comprises the following operating steps:
- said at least one presence sensor 20 does not detect any persons moving at a level where access can be gained to said control station 22;
- said at least one presence sensor 20 detects the presence of a solid body in said monitoring region;
- said at least one presence sensor 20 sends to said control system 9 a detection signal representative of the presence of said solid body;
- said foundation construction machine 1 executes at least one predetermined function on the basis of said at least one control signal.

In addition to the above, said method for controlling a foundation construction machine 1 may also comprise the following operating steps:

- said control system 9 sends at least one control signal when said detection signal is representative of the presence of a solid body situated in proximity to said at least one walkway surface 7, 16, 18, 21;
- said foundation construction machine 1 executes at least one predetermined function on the basis of said at least one control signal.

Other functional and structural details of the method have already been described above with reference to the embodiments and construction variants of foundation construction machine 1 and will not therefore be repeated for brevity's sake, but should be understood to be applicable to the present method without requiring any further description or explanation.

Of course, without prejudice to the principle of the invention, the various embodiments, construction variants and implementation details may be extensively varied from those described and illustrated herein by way of non-limiting example, without however departing from the scope of the invention as set out in the appended claims.

In particular, as aforementioned, the technical features that differentiate the various embodiments and variants thereof described and illustrated herein are freely interchangeable, whenever compatible.

The invention claimed is:

1. A foundation construction machine comprising:

- a self-moving or mobile assembly configured to move on the ground, and moving the foundation construction machine;
- an upper structure, mechanically connected to said self-moving or mobile assembly, said upper structure being equipped with at least one predefined access point configured to allow a person to gain access to said upper structure, and being equipped with at least one walkway surface, whereon a person accessing the upper structure will be able to stand or walk;

a mast or boom, mechanically connected to the upper structure, whereon an operating equipment is configured to be mounted to drill the ground;

at least one presence sensor integrally mounted to the upper structure, oriented and configured to monitor a monitoring region integral with said upper structure and covering said at least one walkway surface, said at least one presence sensor being configured for detecting presence of a solid body in said monitoring region and for sending a detection signal representative of the presence of said solid body;

a control system operationally connected to said at least one presence sensor, configured for receiving said detection signal from said at least one presence sensor and for sending at least one control signal to cause said foundation construction machine to execute at least one predetermined function when said detection signal is representative of the presence of a solid body situated in proximity to said at least one walkway surface.

2. The foundation construction machine according to claim 1, wherein said upper structure further comprises a control station for accommodating an operator, enabling the operator to send commands to said foundation construction machine; said at least one presence sensor is mounted and oriented on said upper structure such that said monitoring region excludes walkway surfaces through which said control station is accessible.

3. The foundation construction machine according to claim 1, wherein said at least one walkway surface is adjacent to said at least one predefined access point.

4. The foundation construction machine according to claim 1, wherein said at least one walkway surface is a walkway surface internal to the upper structure.

5. The foundation construction machine according to claim 1, wherein said at least one presence sensor is oriented and configured for monitoring a monitoring region integral with said upper structure and covering a plurality of walkway surfaces.

6. The foundation construction machine according to claim 1, wherein said at least one walkway surface is situated in a position from which at least one winch mounted to the upper structure is accessible.

7. The foundation construction machine according to claim 1, further comprising at least one access sensor integrally mounted to the upper structure, oriented, and configured to monitor a monitoring region integral with the upper structure and including said at least one predefined access point, to detect the presence of a solid body in said monitoring region and send a detection signal representative of the presence of said solid body;

said control system being operationally connected to said at least one access sensor and configured for receiving said detection signal from said at least one access sensor and for sending at least one control signal to cause said foundation construction machine to execute at least one predetermined function when said detection signal received from said at least one access sensor is representative of the presence of a solid body situated in proximity to said at least one predefined access point.

8. The foundation construction machine according to claim 1, wherein said at least one predetermined function is executed automatically by the foundation construction machine through said control signal sent by the control system and having priority over any commands issued by the operator of the machine.

9. The foundation construction machine according to claim 1, wherein said at least one predetermined function is selected from the following group of predetermined functions:

emitting one or more alarm signals, and preventing at least one part, component or device of the foundation construction machine from moving.

10. The foundation construction machine according to claim 1, wherein said control system allows stopping, in a semi-manual manner, execution of said at least one predetermined function when said at least one presence sensor and/or said at least one access sensor is not detecting the presence of the solid body within the respective monitoring region.

11. The foundation construction machine according to claim 1, wherein said control system is configured for detecting a fault in said at least one access sensor and/or said at least one presence sensor and/or said control system.

12. The foundation construction machine according to claim 11, wherein said control system is further configured to cause said foundation construction machine to execute said at least one predetermined function when said control system detects said fault.

13. The foundation construction machine according to claim 1, further comprising a cover mechanically connected to the upper structure, said at least one presence sensor being mounted under or inside said cover.

14. The foundation construction machine according to claim 13, wherein said cover has a lateral aperture through which an electromagnetic radiation emitted by the at least one presence sensor can pass.

15. The foundation construction machine according to claim 14, wherein said cover is equipped with lateral fins.

16. The foundation construction machine according to claim 15, wherein said lateral fins are foldable.

17. The foundation construction machine according to claim 1, wherein said at least one access sensor and/or said at least one presence sensor is configured to detect the position of a solid body within the respective monitoring region.

18. The foundation construction machine according to claim 17, wherein said at least one access sensor and/or said at least one presence sensor is a laser scanner sensor.

19. The foundation construction machine according to claim 1, wherein said at least one access sensor and/or said at least one presence sensor has a variable spatial resolution.

20. The foundation construction machine according to claim 1, wherein said at least one access sensor and/or said at least one presence sensor has a variable field of view.

21. The foundation construction machine according to claim 1, wherein the control signal sent by said control system is transmitted via a dual-channel connection.

22. The foundation construction machine according to claim 1, wherein said control system is configured to send a deactivation signal to said at least one access sensor and/or said at least one presence sensor in order to temporarily suspend detection of the presence of a solid body by said at least one access sensor and/or said at least one presence sensor.

23. The foundation construction machine according to claim 1, wherein said control system is configured to execute an initial memorization of the solid bodies detected by said at least one access sensor and/or said at least one presence sensor within the respective monitoring region.

24. The foundation construction machine according to claim 23, wherein said control system is configured to send said at least one control signal when said at least one access sensor and/or said at least one presence sensor detects, in the respective monitoring region, a solid body which is different from solid bodies previously stored during initial memorization.

25. The foundation construction machine according to claim 1, comprising a plurality of access sensors and/or a plurality of the presence sensors.

26. A method for controlling a foundation construction machine;

said foundation construction machine comprising:

a self-moving or mobile assembly configured to move on ground, and moving the foundation construction machine;

an upper structure, mechanically connected to said self-moving or mobile assembly, equipped with at least one predefined access point configured to allow a person to gain access to said upper structure, and equipped with at least one walkway surface;

a mast or boom, mechanically connected to the upper structure, whereon an operating equipment is configured to be mounted to drill the ground;

at least one presence sensor integrally mounted to the upper structure, which is oriented and configured to monitor a monitoring region integral with said upper structure and covering said at least one walkway surface, said at least one presence sensor being configured for detecting presence of a solid body in said monitoring region and for sending a detection signal representative of the presence of said solid body;

a control system operationally connected to said at least one presence sensor; wherein said method comprises the following operating steps:

said at least one presence sensor detects the presence of a solid body in said monitoring region;

said at least one presence sensor sends to said control system a detection signal representative of the presence of said solid body;

said control system sends at least one control signal when said detection signal is representative of the presence of a solid body situated in proximity to said at least one walkway surface;

said foundation construction machine executes at least one predetermined function based on said at least one control signal.

27. The method for controlling a foundation construction machine according to claim 26, wherein said upper structure further comprises a control station to accommodate an operator, enabling the operator to send commands to said foundation construction machine; and wherein said at least one presence sensor does not detect the presence of any solid bodies passing in an area through which access can be gained to said control station, said at least one presence sensor being mounted and oriented on said upper structure such that said monitoring region excludes walkway surfaces through which said control station is accessible.

* * * * *